US011827477B2

(12) United States Patent
Tsai et al.

(10) Patent No.: US 11,827,477 B2
(45) Date of Patent: Nov. 28, 2023

(54) MEDIUM PASSAGE SWITCHING MECHANISM DISPOSED ON A CASING OF AN IMAGE FORMING DEVICE AND RELATED IMAGE FORMING DEVICE

(71) Applicant: AVISION INC., Hsinchu (TW)

(72) Inventors: Wei-Lun Tsai, Hsinchu (TW); Min-Hao Chang, Taipei (TW)

(73) Assignee: AVISION INC., Hsinchu (TW)

( * ) Notice: Subject to any disclaimer, the term of this patent is extended or adjusted under 35 U.S.C. 154(b) by 305 days.

(21) Appl. No.: 17/474,066

(22) Filed: Sep. 14, 2021

(65) Prior Publication Data

US 2022/0177254 A1 Jun. 9, 2022

(30) Foreign Application Priority Data

Dec. 7, 2020 (TW) ..... 109143012

(51) Int. Cl.
*B65H 29/58* (2006.01)
*G03G 15/23* (2006.01)

(52) U.S. Cl.
CPC ..... *B65H 29/58* (2013.01); *G03G 15/234* (2013.01); *B65H 2404/63* (2013.01); *B65H 2405/324* (2013.01); *B65H 2407/21* (2013.01); *B65H 2801/06* (2013.01)

(58) Field of Classification Search
CPC ..... B65H 5/32; B65H 29/58; B65H 2407/21; G03G 15/234
USPC ..... 271/303–305
See application file for complete search history.

(56) References Cited

U.S. PATENT DOCUMENTS 5,145,160 A * 9/1992 Nagashima ..... G03G 15/6514 271/170
8,246,037 B2 * 8/2012 Huang ..... H04N 1/00615 271/3.14
8,770,573 B2 * 7/2014 Kondo ..... B65H 3/44 271/9.01
8,864,124 B2 * 10/2014 Yamamoto ..... B65H 3/44 271/9.13
10,841,442 B2 * 11/2020 Shimazu ..... H04N 1/00557
10,864,757 B2 * 12/2020 Sasaki ..... B41J 13/009
2019/0375218 A1 * 12/2019 Sasaki ..... B65H 29/58

FOREIGN PATENT DOCUMENTS

TW 399527 7/2000
TW M299984 10/2006

* cited by examiner

*Primary Examiner* — Patrick Cicchino
(74) *Attorney, Agent, or Firm* — Winston Hsu

(57) ABSTRACT

A medium passage switching mechanism disposed on a casing of an image forming device, includes a medium tray, a guiding component and a resilient component. An entrance passage, a first exit passage and a second exit passage are formed inside the casing. The medium tray is pivoted to the casing and can pivot between a first position and a second position. The guiding component is pivoted to the casing and can pivot between a third position and a fourth position. The resilient component abuts against the guiding component and the casing. When the medium tray pivots between the first position and the second position, the guiding component can be driven by cooperation of the resilient component and the medium tray to pivot between the third position and the fourth position for guiding a medium to enter into the first exit passage or the second exit passage from the entrance passage.

18 Claims, 8 Drawing Sheets

MEDIUM PASSAGE SWITCHING MECHANISM DISPOSED ON A CASING OF AN IMAGE FORMING DEVICE AND RELATED IMAGE FORMING DEVICE

BACKGROUND OF THE DISCLOSURE

1. Field of the Disclosure

The present invention relates to a medium passage switching mechanism disposed on a casing of an image forming device and a related image forming device, and more particularly, to a medium passage switching mechanism capable of guiding different media to enter into different exit passages selectively and a related image forming device.

2. Description of the Prior Art

Image forming devices, such as scanners or printers, are widely used in families or offices for bringing convenience in people's lives. In order to capture images of different types of scanned media, e.g., paper or cards, or to form images on different types of printed media, e.g., paper or cards, an image forming device is usually provided with different passages and a switching mechanism, so that a user can operate the switching mechanism according to a type of the scanned medium or the printed medium, so as to allow the scanned medium or the printed medium to pass through a proper passage for preventing any obstruction of the image forming device caused by the scanned medium or the printed medium entering into a wrong passage. However, the conventional switching mechanism has complicated structure and difficult operation. Therefore, there is a need to provide an improved switching mechanism.

SUMMARY OF THE DISCLOSURE

It is an objective of the present invention to provide a medium passage switching mechanism disposed on a casing of an image forming device and a related image forming device.

In order to achieve the aforementioned objective, the present invention discloses a medium passage switching mechanism disposed on a casing of an image forming device. An entrance passage, a first exit passage and a second exit passage are formed inside the casing. The medium passage switching mechanism includes a medium tray, a guiding component and at least one resilient component. The medium tray is pivotally connected to the casing and pivotally switchable between a first position and a second position. The guiding component is pivotally connected to the casing and pivotally switchable between a third position and a fourth position. The at least one resilient component abuts against the guiding component. When the medium tray pivots relative to the casing from the first position to the second position along a first pivoting direction, the medium tray does not contact with the guiding component, so that the guiding component is driven by the at least one resilient component to pivot relative to the casing from the third position to the fourth position along the first pivoting direction. When the guiding component is located at the fourth position, the guiding component guides a medium to enter into the second exit passage from the entrance passage. When the medium tray pivots relative to the casing from the second position to the first position along a second pivoting direction opposite to the first pivoting direction, the medium tray abuts against the guiding component to drive the guiding component to pivot relative to the casing from the fourth position to the third position along the second pivoting direction and to compress the at least one resilient component, and when the guiding component is located at the third position, the guiding component guides the medium to enter into the first exit passage from the entrance passage.

According to an embodiment of the present invention, the medium tray includes at least one engaging portion configured to engage with at least one cooperation portion formed on the casing when the medium tray pivots to the first position.

According to an embodiment of the present invention, the guiding component includes a stopping portion configured to abut against the casing when the guiding component is located at the fourth position.

According to an embodiment of the present invention, the medium tray includes at least one abutting portion and at least one pivoting portion, the at least one abutting portion is configured to abut against the guiding component, and the at least one pivoting portion is pivotally connected to the casing.

According to an embodiment of the present invention, the at least one resilient component is a compression spring.

In order to achieve the aforementioned objective, the present invention further discloses an image forming device. The image forming device includes a casing and a medium passage switching mechanism. An entrance passage, a first exit passage and a second exit passage are formed inside the casing. The medium passage switching mechanism is disposed on the casing and for guiding a medium to enter into the first exit passage or the second exit passage from the entrance passage. The medium passage switching mechanism includes a medium tray, a guiding component and at least one resilient component. The medium tray is pivotally connected to the casing and pivotally switchable between a first position and a second position. The guiding component is pivotally connected to the casing and pivotally switchable between a third position and a fourth position. The at least one resilient component abuts against the guiding component. When the medium tray pivots relative to the casing from the first position to the second position along a first pivoting direction, the medium tray does not contact with the guiding component, so that the guiding component is driven by the at least one resilient component to pivot relative to the casing from the third position to the fourth position along the first pivoting direction. When the guiding component is located at the fourth position, the guiding component guides the medium to enter into the second exit passage from the entrance passage. When the medium tray pivots relative to the casing from the second position to the first position along a second pivoting direction opposite to the first pivoting direction, the medium tray abuts against the guiding component to drive the guiding component to pivot relative to the casing from the fourth position to the third position along the second pivoting direction and to compress the at least one resilient component, and when the guiding component is located at the third position, the guiding component guides the medium to enter into the first exit passage from the entrance passage.

According to an embodiment of the present invention, the medium tray includes at least one engaging portion. At least one cooperation portion is formed on the casing, and the at least one engaging portion is configured to engage with the at least one cooperation portion when the medium tray pivots to the first position.

According to an embodiment of the present invention, the guiding component includes a stopping portion configured to abut against the casing when the guiding component is located at the fourth position.

According to an embodiment of the present invention, the medium tray includes at least one abutting portion and at least one pivoting portion. The at least one abutting portion is configured to abut against the guiding component, and the at least one pivoting portion is pivotally connected to the casing.

According to an embodiment of the present invention, the at least one resilient component is a compression spring.

In summary, the medium passage switching mechanism of the present invention utilizes cooperation of the medium tray and the resilient component to drive the guiding component to pivot between the third position and the fourth position when the medium tray pivots between the first position and the second position, so as to guide the medium to enter into the first exit passage or the second exit passage selectively. Therefore, the medium passage switching mechanism has advantages of simple structure and easy operation.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" is intended to mean either an indirect or direct mechanical connection. Thus, if a first device is coupled to a second device, that connection may be through a direct mechanical connection, or through an indirect mechanical connection via other devices and connections.

Figure 1:
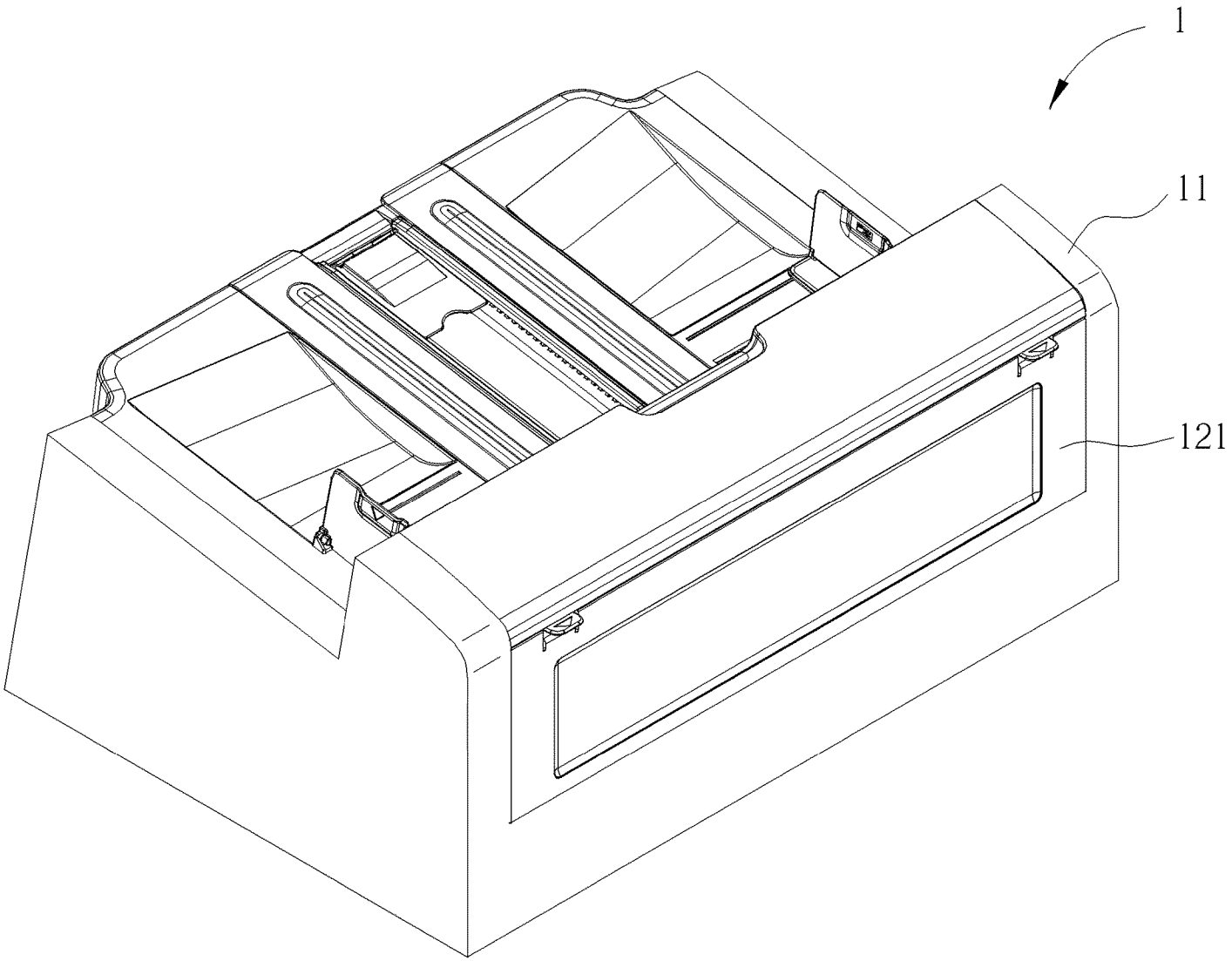
FIG. 1 is a schematic diagram of an image forming device according to an embodiment of the present invention.
Figure 2:
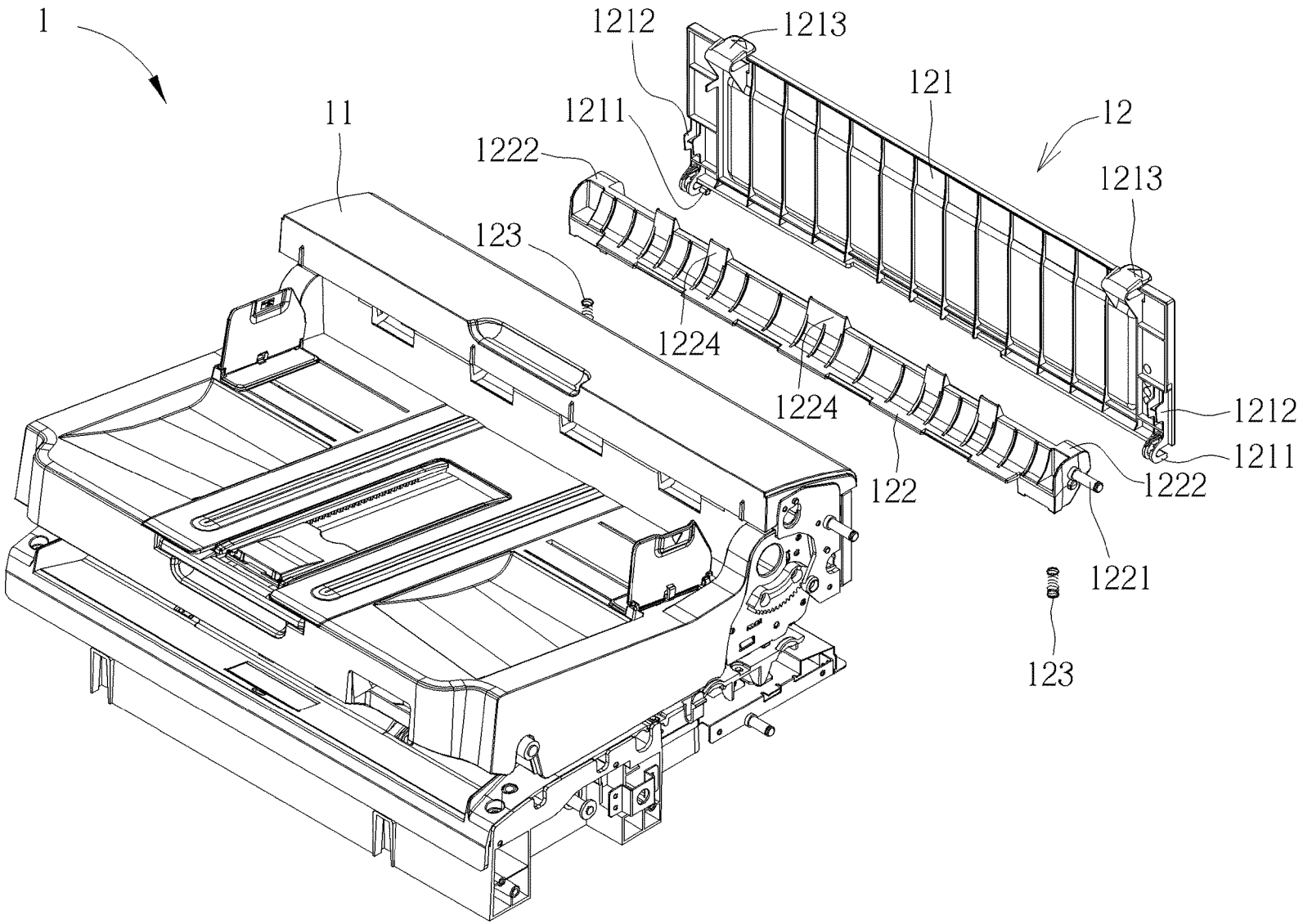
FIG. 2 and FIG. 3 are partial exploded diagrams of the image forming device at different views according to the embodiment of the present invention.
Figure 3:
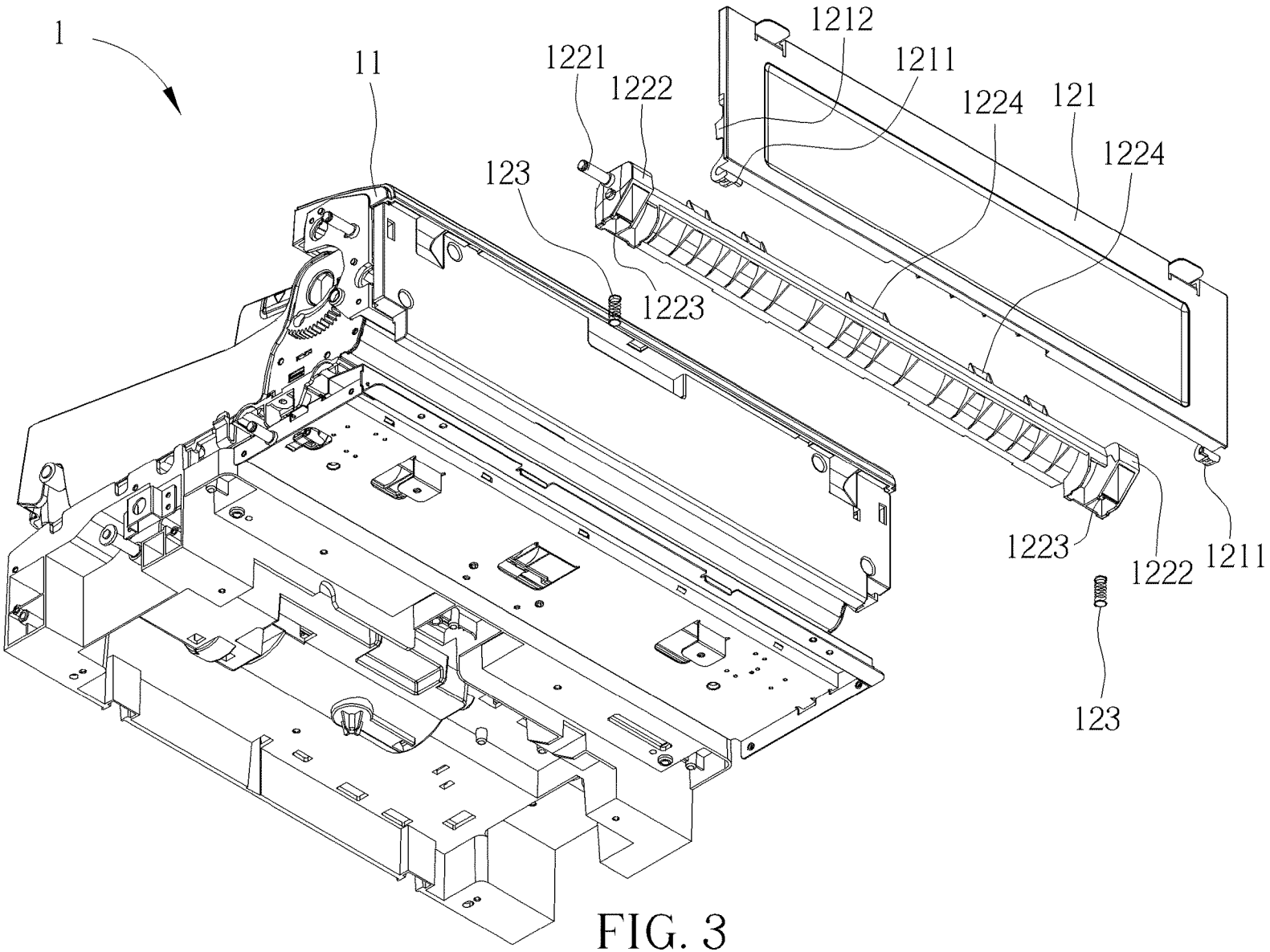
Figure 4:
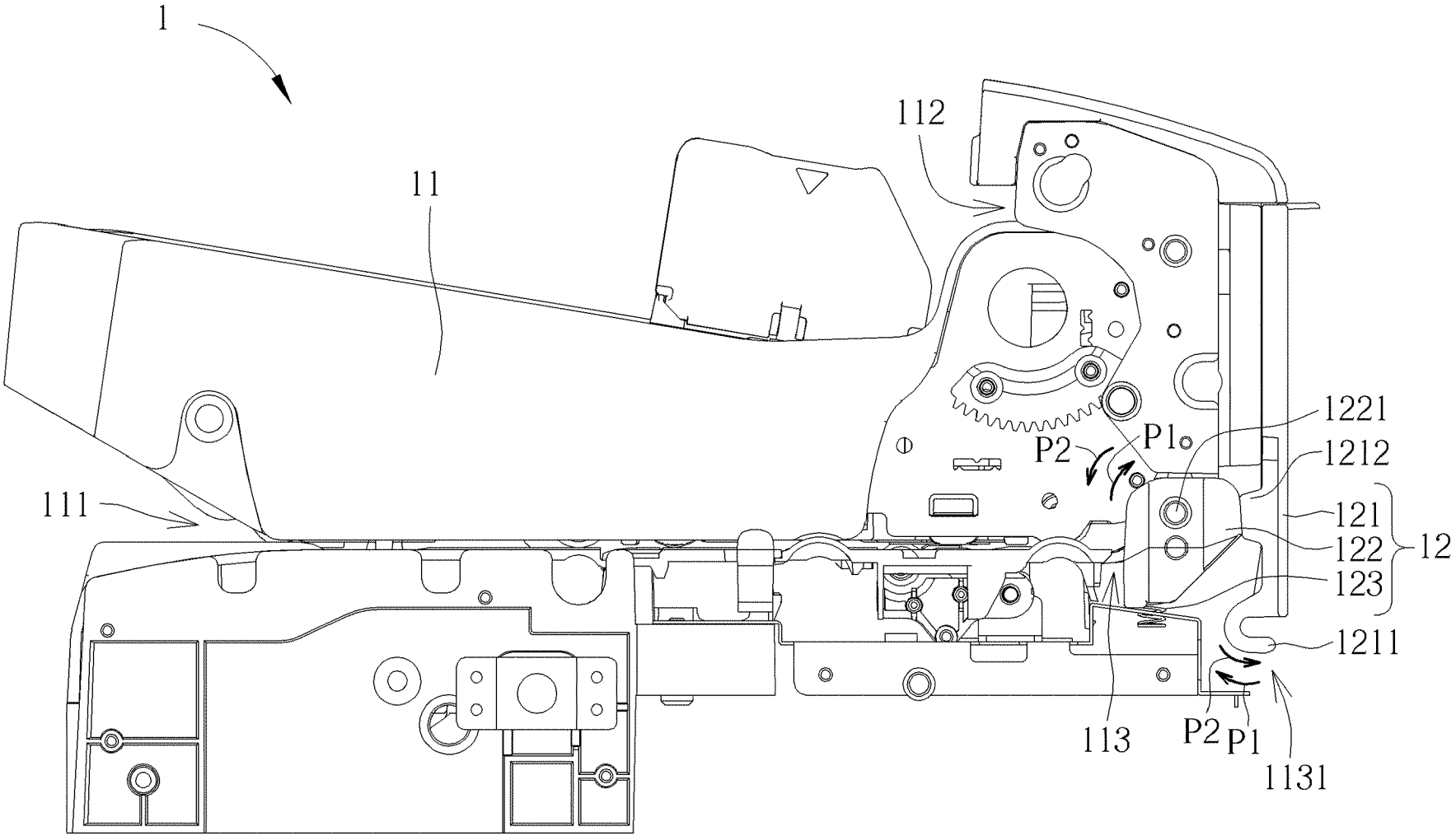
FIG. 4 is a partial diagram of the image forming device in a first state according to the embodiment of the present invention.
Figure 5:
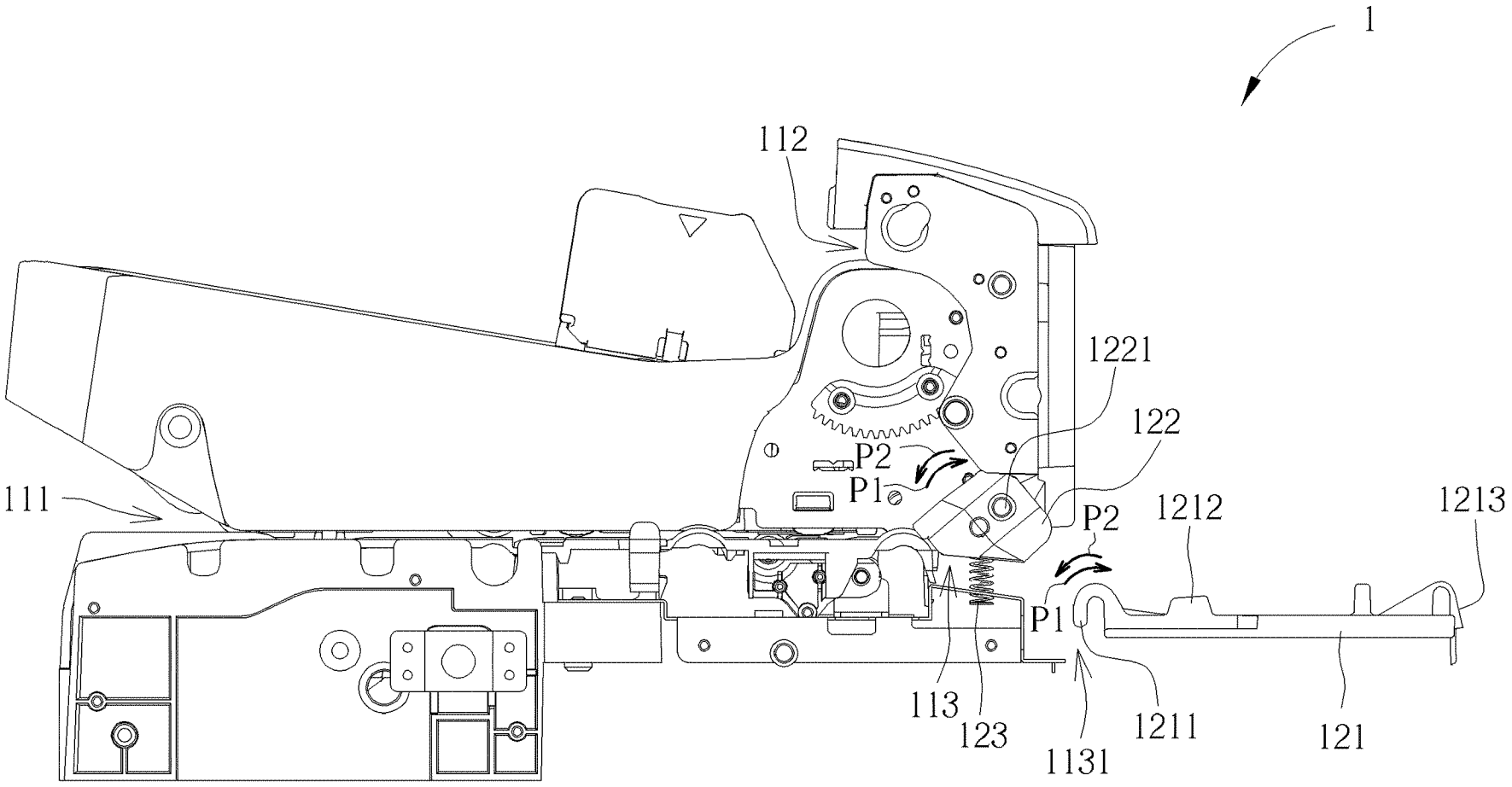
FIG. 5 is a partial diagram of the image forming device in a second state according to the embodiment of the present invention.
Figure 6:
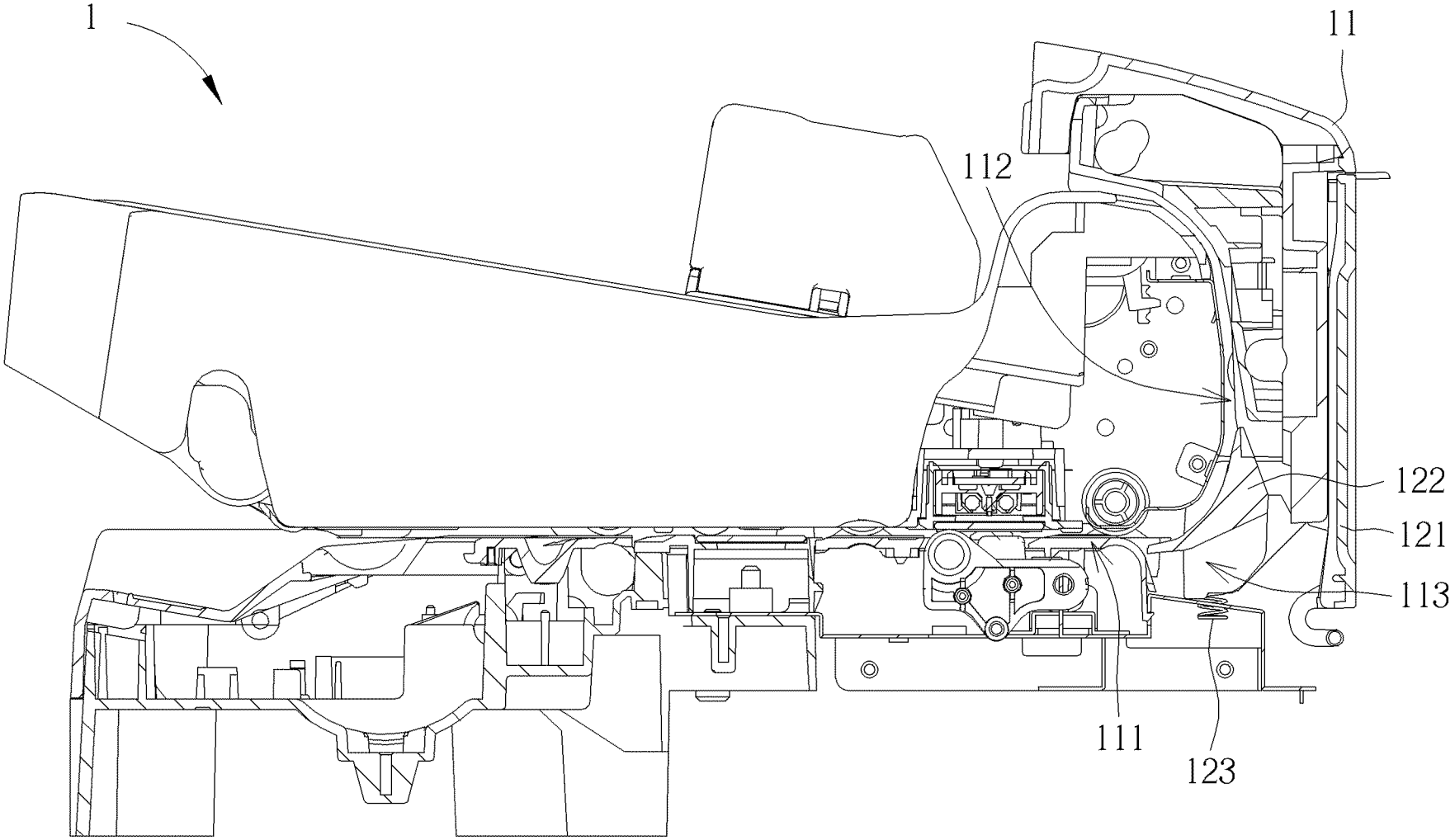
FIG. 6 is a partial sectional diagram of the image forming device in the first state according to the embodiment of the present invention.
Figure 7:
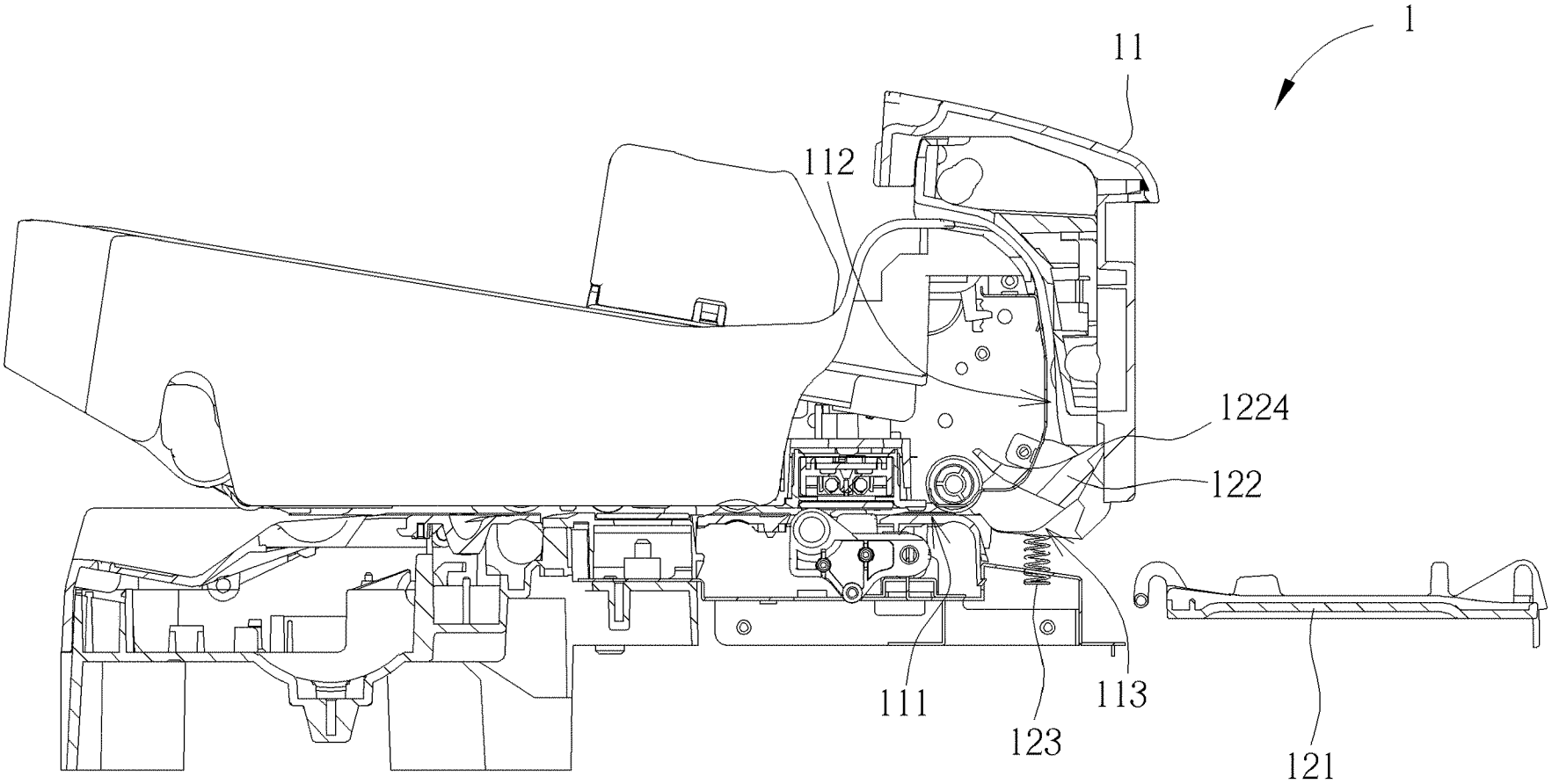
FIG. 7 is a partial sectional diagram of the image forming device in the second state according to the embodiment of the present invention.

Please refer to FIG. 1 to FIG. 7. FIG. 1 is a schematic diagram of an image forming device 1 according to an embodiment of the present invention. FIG. 2 and FIG. 3 are partial exploded diagrams of the image forming device 1 at different views according to the embodiment of the present invention. FIG. 4 is a partial diagram of the image forming device 1 in a first state according to the embodiment of the present invention. FIG. 5 is a partial diagram of the image forming device 1 in a second state according to the embodiment of the present invention. FIG. 6 is a partial sectional diagram of the image forming device 1 in the first state according to the embodiment of the present invention. FIG. 7 is a partial sectional diagram of the image forming device 1 in the second state according to the embodiment of the present invention. As shown in FIG. 1 to FIG. 7, the image forming device 1 includes a casing 11 and a medium passage switching mechanism 12. An entrance passage 111, a first exit passage 112 and a second exit passage 113 are formed inside the casing 11. The entrance passage 111 is communicated with the first exit passage 112 and the second exit passage 113. The medium passage switching mechanism 12 is disposed on the casing 11 and configured to guide a medium, such as a document paper sheet, a photo paper sheet or a card, to enter into the first exit passage 112 or the second exit passage 113 from the entrance passage 111. For example, when the medium is a document paper sheet which is made of softer material, a user can operate the medium passage switching mechanism 12 to switch the image forming device 1 to the first state as shown in FIG. 4 and FIG. 6, so as to guide the medium to enter into the first exit passage 112 from the entrance passage 111. When the medium is a card which is made of harder material, the user can operate the medium passage switching mechanism 12 to switch the image forming device 1 to the second state as shown in FIG. 5 and FIG. 7, so as to guide the medium enter into the second exit passage 113 from the entrance passage 111.

The medium passage switching mechanism 12 includes a medium tray 121, a guiding component 122 and two resilient components 123. The medium tray 121 is pivotally connected to the casing 11 and located adjacent to an exit end 1131 of the second exit passage 113 away from the entrance passage 111. The medium tray 121 is pivotally switchable between a first position as shown in FIG. 4 and FIG. 6 and a second position as shown in FIG. 5 and FIG. 7. The medium tray 121 can be driven to pivot by the user's hand or by any other electrical or mechanical mechanism. The guiding component 122 is pivotally connected to the casing 11 and located adjacent to where the entrance passage 111 is communicated with the first exit passage 112 and the second exit passage 113. The guiding component 122 is pivotally switchable between a third position as shown in FIG. 4 and FIG. 6 and a fourth position as shown in FIG. 5 and FIG. 7. The two resilient components 123 are located at two opposite sides of the guiding component 122 and abut against the guiding component 122. For example, an end of each of the resilient components 123 can abut against the guiding component 122, and the other end of each of the resilient components 123 can be sleeved on a fixing column, which is not shown in the figures, protruding from the casing 11. When the medium tray 121 pivots relative to the casing 11 between the first position as shown in FIG. 4 and FIG. 6 and the second position as shown in FIG. 5 and FIG. 7, the guiding component 122 can be driven by cooperation of the two resilient components 123 and the medium tray 121 to pivot between the third position as shown in FIG. 4 and FIG. 6 and the fourth position as shown in FIG. 5 and FIG. 7, so as to guide the medium to enter into the first exit passage 112 or the second exit passage 113 selectively from the entrance passage 111.

Specifically, in order to drive the guiding component 122 by the cooperation of the two resilient components 123 and the medium tray 121 to pivot between the third position as shown in FIG. 4 and the fourth position as shown in FIG. 5 when the medium tray 121 pivots relative to the casing 11 between the first position as shown in FIG. 4 and FIG. 6 and the second position as shown in FIG. 5 and FIG. 7, in this embodiment, each of the resilient components 123 can be a compression spring abutting against the guiding component 122.

Furthermore, the medium tray 121 includes two pivoting portions 1211 and two abutting portions 1212. Each of the pivoting portions 1211 is pivotally connected to the casing 11. Each of the abutting portions 1212 is spaced apart from the corresponding pivoting portion 1211 and configured to abut against the guiding component 122 for driving the guiding component 122 to pivot from the fourth position as shown in FIG. 5 and FIG. 7 to the third position as shown in FIG. 4 and FIG. 6 during a pivotal movement of the medium tray 121 from the second position as shown in FIG. 5 and FIG. 7 to the first position as shown in FIG. 4 and FIG. 6.

Besides, the guiding component 122 includes a guiding pivoting portion 1221, a first guiding abutting portion 1222, two second guiding abutting portions 1223 and fives stopping portions 1224. The guiding pivoting portion 1221 is pivotally connected to the casing 11. The five stopping portions 1224 are configured to abut against the casing 11 when the guiding component 122 is located at the fourth position, so that the guiding component 122 can be positioned at the fourth position when the medium tray 121 is located at the second position. The first guiding abutting portion 1222 and each of the second guiding abutting portions 1223 are respectively configured to abut against the abutting portion 1212 of the medium tray 121 and the corresponding resilient component 123. A direction of a torque applied on the guiding component 122 by a resilient force of each of the resilient components 123 is opposite to a direction of a torque applied on the guiding component 122 by a pushing force of the medium tray 121.

However, the structure of the medium passage switching mechanism of the present invention is not limited to this embodiment. Any mechanism which utilizes cooperation of the medium tray and the resilient component to drive the guiding component to pivot between the third position and the fourth position when the medium tray pivots between the first position and the second position is included within the scope of the present invention. For example, in another embodiment, there can be only one pivoting portion at a central portion of the medium tray, one abutting portion at one side of the medium tray, one second guiding abutting portion at a central portion of the guiding component and one stopping portion at one side of the guiding component, and the medium passage switching mechanism can include one resilient abutting against the second guiding abutting portion located at the central portion of the guiding component.

As shown in FIG. 4 to FIG. 7, when the medium is a card, the user can operate the medium tray 121 to pivot relative to the casing 11 from the first position as shown in FIG. 4 to the second position as shown in FIG. 5 along a first pivoting direction P1. As shown in FIG. 5, when the medium tray 121 is located at the second position, the medium tray 121 does not contact with the guiding component 122. Therefore, the guiding component 122 can be driven by the two resilient components 123 to pivot relative to the casing 11 from the third position as shown in FIG. 4 to the fourth position as shown in FIG. 5 along the first pivoting direction P1. As shown in FIG. 5 and FIG. 7, when the guiding component 122 is located at the fourth position, the guiding component 122 blocks a communication of the first exit passage 112 and the entrance passage 111 but does not block a communication of the second exit passage 113 and the entrance passage 111. Therefore, the guiding component 122 located at the fourth position can guide the medium to enter into the second exit passage 113 from the entrance passage 111. When the medium is a document paper sheet, the user can operate the medium tray 121 to pivot relative to the casing 11 from the second position as shown in FIG. 5 to the first position as shown in FIG. 4 along a second pivoting direction P2 opposite to the first pivoting direction P1 for driving the medium tray 121 to abut against the guiding component 122 to drive the guiding component 122 to pivot relative to the casing 11 from the fourth position as shown in FIG. 5 to the third position as shown in FIG. 4 along the second pivoting direction P2 and compress the two resilient components 123. As shown in FIG. 4 and FIG. 6, when the guiding component 122 is located at the third position, the guiding component 122 blocks the communication of the second exit passage 113 and the entrance passage 111 but does not block the communication of the first exit passage 112 and the entrance passage 111. Therefore, the guiding component 122 located at the third position can guide the medium to enter into the first exit passage 112 from the entrance passage 111.

Figure 8:
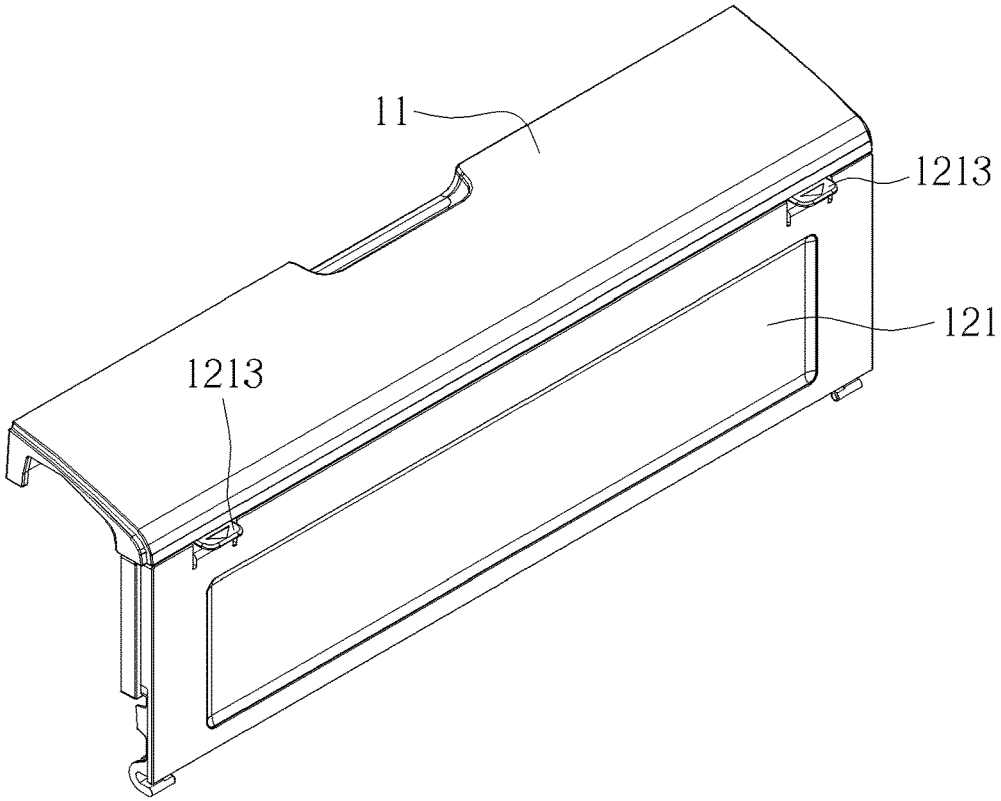
FIG. 8 is a partial diagram of the image forming device as a medium tray is located at a first position according to the embodiment of the present invention.
Figure 9:
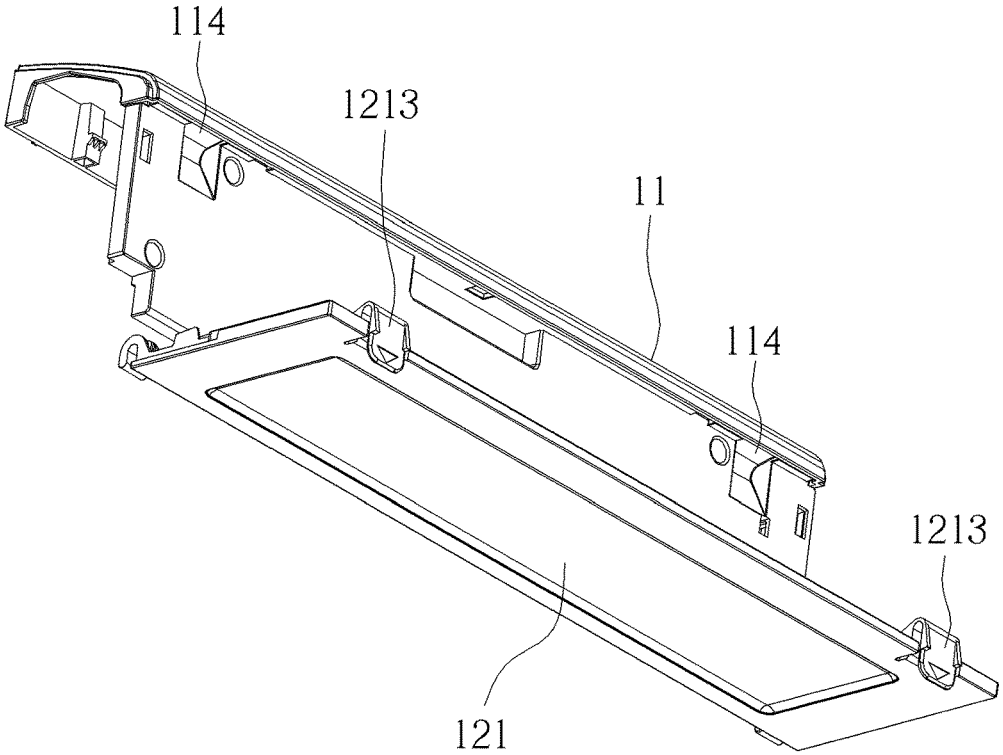
FIG. 9 is a partial diagram of the image forming device as the medium tray is located at a second position according to the embodiment of the present invention.

Please further refer to FIG. 4, FIG. 5, FIG. 8 and FIG. 9. FIG. 8 is a partial diagram of the image forming device 1 as the medium tray 121 is located at the first position according to the embodiment of the present invention. FIG. 9 is a partial diagram of the image forming device 1 as the medium tray 121 is located at the second position according to the embodiment of the present invention. As shown in FIG. 4, FIG. 5, FIG. 8 and FIG. 9, in this embodiment, when the medium tray 121 and the guiding component 122 are located at the first position and the third position respectively, a resilient force generated by each of the resilient components 123 biases the guiding component 122 to depart from the third position, so as to bias the medium tray 121 to depart from the first position. Therefore, in order to prevent the medium tray 121 and the guiding component 122 from departing from the first position and the third position respectively, the medium tray 121 includes two engaging portion 1213. Two cooperation portions 114 are formed on the casing 11. When the medium tray 121 pivots to the first position, each of the engaging portions 1213 engages with the corresponding cooperation portion 114, so as to position the medium tray 121 and the guiding component 122 at the first position and the third position respectively. Furthermore, the present invention also can be configured to drive the guiding component 122 to depart from the third position by the resilient components 123 for driving the medium tray 121 to depart from the first position, e.g., to drive the guiding component 122 to pivot to the fourth position for driving the medium tray 121 to pivot to the second position, when the engaging portions of the medium tray 121 do not engage with the cooperation portions 114 on the casing 11.

Preferably, in this embodiment, each of the engaging portions 1213 can be an engaging hook, and each of the cooperation portions 114 can be a notch. However, the structure and the number of the engaging portion of the present invention are not limited to this embodiment. For example, in another embodiment, the medium tray can include only one engaging portion, and there can be only one cooperation portion formed on the casing, wherein the engaging portion and the cooperation portion can be a notch and an engaging hook respectively. Alternatively, in another embodiment, the engaging portion and the cooperation portion can be omitted as long as the resilient force can be configured to be overcome by any other mechanism, e.g., friction.

In summary, the medium passage switching mechanism of the present invention utilizes cooperation of the medium tray and the resilient component to drive the guiding component to pivot between the third position and the fourth position when the medium tray pivots between the first position and the second position, so as to guide the medium to enter into the first exit passage or the second exit passage selectively. Therefore, the medium passage switching mechanism has advantages of simple structure and easy operation.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A medium passage switching mechanism disposed on a casing of an image forming device, an entrance passage, a first exit passage and a second exit passage being formed inside the casing, the medium passage switching mechanism comprising:

a medium tray pivotally connected to the casing and pivotally switchable between a first position and a second position;

a guiding component pivotally connected to the casing and pivotally switchable between a third position and a fourth position; and at least one resilient component abutting against the guiding component;

wherein when the medium tray pivots relative to the casing from the first position to the second position along a first pivoting direction, the medium tray does not contact with the guiding component, so that the guiding component is driven by the at least one resilient component to pivot relative to the casing from the third position to the fourth position along the first pivoting direction, when the guiding component is located at the fourth position, the guiding component guides a medium to enter into the second exit passage from the entrance passage, when the medium tray pivots relative to the casing from the second position to the first position along a second pivoting direction opposite to the first pivoting direction, the medium tray abuts against the guiding component to drive the guiding component to pivot relative to the casing from the fourth position to the third position along the second pivoting direction and to compress the at least one resilient component, and when the guiding component is located at the third position, the guiding component guides the medium to enter into the first exit passage from the entrance passage.

2. The medium passage switching mechanism of claim 1, wherein the medium tray comprises at least one engaging portion configured to engage with at least one cooperation portion formed on the casing when the medium tray pivots to the first position.

3. The medium passage switching mechanism of claim 1, wherein the guiding component comprises a stopping portion configured to abut against the casing when the guiding component is located at the fourth position.

4. The medium passage switching mechanism of claim 1, wherein the medium tray comprises at least one abutting portion and at least one pivoting portion, the at least one abutting portion is configured to abut against the guiding component, and the at least one pivoting portion is pivotally connected to the casing.

5. The medium passage switching mechanism of claim 4, wherein the medium tray comprises at least one engaging portion configured to engage with at least one cooperation portion formed on the casing when the medium tray pivots to the first position.

6. The medium passage switching mechanism of claim 4, wherein the guiding component comprises a stopping portion configured to abut against the casing when the guiding component is located at the fourth position.

7. The medium passage switching mechanism of claim 1, wherein the at least one resilient component is a compression spring.

8. The medium passage switching mechanism of claim 7, wherein the medium tray comprises at least one engaging portion configured to engage with at least one cooperation portion formed on the casing when the medium tray pivots to the first position.

9. The medium passage switching mechanism of claim 7, wherein the guiding component comprises a stopping portion configured to abut against the casing when the guiding component is located at the fourth position.

10. An image forming device comprising:

a casing, an entrance passage, a first exit passage and a second exit passage being formed inside the casing; and a medium passage switching mechanism disposed on the casing and for guiding a medium to enter into the first exit passage or the second exit passage from the entrance passage, the medium passage switching mechanism comprising:

a medium tray pivotally connected to the casing and pivotally switchable between a first position and a second position;

a guiding component pivotally connected to the casing and pivotally switchable between a third position and a fourth position; and at least one resilient component abutting against the guiding component;

wherein when the medium tray pivots relative to the casing from the first position to the second position along a first pivoting direction, the medium tray does not contact with the guiding component, so that the guiding component is driven by the at least one resilient component to pivot relative to the casing from the third position to the fourth position along the first pivoting direction, when the guiding component is located at the fourth position, the guiding component guides the medium to enter into the second exit passage from the entrance passage, when the medium tray pivots relative to the casing from the second position to the first position along a second pivoting direction opposite to the first pivoting direction, the medium tray abuts against the guiding component to drive the guiding component to pivot relative to the casing from the fourth position to the third position along the second pivoting direction and to compress the at least one resilient component, and when the guiding component is located at the third position, the guiding component guides the medium to enter into the first exit passage from the entrance passage.

11. The image forming device of claim 10, wherein the medium tray comprises at least one engaging portion, at least one cooperation portion is formed on the casing, and the at least one engaging portion is configured to engage with the at least one cooperation portion when the medium tray pivots to the first position.

12. The image forming device of claim 10, wherein the guiding component comprises a stopping portion configured to abut against the casing when the guiding component is located at the fourth position.

13. The image forming device of claim 10, wherein the medium tray comprises at least one abutting portion and at least one pivoting portion, the at least one abutting portion is configured to abut against the guiding component, and the at least one pivoting portion is pivotally connected to the casing.

14. The image forming device of claim 13, wherein the medium tray comprises at least one engaging portion, at least one cooperation portion is formed on the casing, and the at least one engaging portion is configured to engage with the at least one cooperation portion when the medium tray pivots to the first position.

15. The image forming device of claim 13, wherein the guiding component comprises a stopping portion configured to abut against the casing when the guiding component is located at the fourth position.

16. The image forming device of claim 10, wherein the at least one resilient component is a compression spring.

17. The image forming device of claim 16, wherein the medium tray comprises at least one engaging portion, at least one cooperation portion is formed on the casing, and the at least one engaging portion is configured to engage with the at least one cooperation portion when the medium tray pivots to the first position.

18. The image forming device of claim 16, wherein the guiding component comprises a stopping portion configured to abut against the casing when the guiding component is located at the fourth position.

* * * * *